United States Patent [19]

Elliston

[11] 4,417,846

[45] Nov. 29, 1983

[54] TRAVELING BLOCK ELEVATOR LATCH ASSEMBLY

[75] Inventor: Thomas L. Elliston, Forth Worth, Tex.

[73] Assignee: Hydra-Rig, Inc., Ft. Worth, Tex.

[21] Appl. No.: 858,948

[22] Filed: Dec. 9, 1977

[51] Int. Cl.[3] ..... E21B 19/00

[52] U.S. Cl. ..... 414/745; 294/90; 414/22

[58] Field of Search ..... 214/2.5, 1 P; 175/52, 175/85; 294/86.29, 86.33, 67 BA, 90; 414/745, 22

[56] References Cited

U.S. PATENT DOCUMENTS

| | | | |
|---|---|---|---|
| 2,410,262 | 10/1946 | Breaux | 294/86.29 |
| 3,063,509 | 11/1962 | Guier | 175/85 |
| 3,193,116 | 7/1965 | Kenneday et al. | 214/2.5 |
| 3,206,242 | 9/1965 | Fensin | 294/67 BA |
| 3,554,594 | 1/1971 | Thoma | 294/90 |
| 3,939,990 | 2/1976 | Johnson | 214/1 P |

*Primary Examiner*—Joseph F. Peters, Jr.
*Assistant Examiner*—Ross Weaver
*Attorney, Agent, or Firm*—Hubbard, Thurman, Turner & Tucker

[57] ABSTRACT

Apparatus for supporting a length of pipe to accommodate pipe stabbing and removal operations during launching or recovery of the length of pipe is disclosed. The apparatus is designed for use with a hoist rig of the type having a mast structure secured to a support platform, a traveling block, and power means including a sheave and cable assembly supported by the mast structure which are operatively connected to raise and lower the traveling block. A detachable elevator block is provided for supporting the length of pipe in a make up position at a stabbing station on the support platform. Latching means are carried by the traveling block for releasably coupling the elevator block to the traveling block during pipe running and recovery operations. In a preferred embodiment, the latching means are mounted for reciprocal and pivotal movement within a latching chamber of the traveling block. Extensible linear actuating means interconnect the traveling block and the latching means for effecting movement of the latching means within the latching chamber between an extended coupling position and a retracted released position. The latching means are guided by wall portions of the latching chamber and are radially displaced to permit positive engagement or disengagement of the latching means with the elevator block in response to reciprocal movement of the latching means between the retracted position and the extended position, respectively.

19 Claims, 14 Drawing Figures

TRAVELING BLOCK ELEVATOR LATCH ASSEMBLY

BACKGROUND OF THE INVENTION

1. Field of the Invention

The present invention relates to apparatus for handling heavy equipment, and more particularly, the invention relates to apparatus for supporting a length of pipe to accommodate pipe stabbing or removal operations during launching or recovery of the length of pipe through an opening in a support platform on a deep ocean mining vessel.

2. Description of the Prior Art

The potential of the ocean for supplying important and basic raw materials is generally recognized. Mining operations for sand, gravel, shell and other materials from continental shelf deposits are presently being performed by dredging techniques. On the ocean floor in deeper waters are vast quantities of mineral deposits. Among these deposits are mineral concentrations spread over large areas of the ocean floor in the form of nodules. Existence of nodules on the ocean bottom has been known for many years and are believed to be formed over aeons of time due to the precipitation of the mineral substances out of the seawater. These nodules are known to consist essentially of iron oxide, manganese oxide, copper, cobalt and nickel, and are generally found in the deep areas of the sea where the floor is relatively hard and flat. The areas in which the nodules are presently known to exist in sufficient quantities to sustain a profitable mining operation are found generally more than 200 miles offshore and at depths of up to 18,000 feet and more.

Among the numerous systems which have been conceived for the recovery of nodules from the ocean floor is the hydraulic system which generally consists of a pipestring which is suspended from a floating platform or vessel. The system includes a gathering head which is designed to collect and winnow the nodules from the ocean floor sediments and transport them through the pipestring. Means are provided for causing the water inside the pipestring to flow upward with sufficient velocity to draw the nodules into the system and transport them to the surface.

One of the major problems associated with this mining method is the provision of apparatus for handling lengths of pipe during launching and recovering the pipestring which permits efficient execution of the launching and recovery operations. Since the load of a pipestring for working in depths up to 18,000 feet may exceed 5,000 kips, it will be appreciated that apparatus for handling the pipestring in such deep ocean mining operations must be capable of handling unusually large loads. Such large loads exceed the radial collapse strength of pipes typically used to make up the pipestring. Therefore conventional support apparatus of the type which engages the tubular body portion of the pipe and imposes a radial load on the wall of the pipe to prevent slipping is unsatisfactory because of the risk of collapsing or weakening the wall of the pipe.

A factor which must be considered in addition to the preservation of the structural integrity of the pipe sections is the efficient execution of the launching and recovery operations. The efficiency of the pipe handling operations depends upon such factors as the running speed of the hoist rig, the time required to make up or break a tool joint during stabbing operations, the time required to mechanically couple and decouple the hoist rig and the pipestring, and the time required to transport a length of pipe from the pipestring to a storage station during recovery operations or to transport a length of pipe from the storage station to the pipestring during launching operations. Because of the requirement that the pipestring be supported without imposing compressive loads upon the tubular body portion of the pipestring, conventional coupling devices, for example those with gripping jaws, cannot be used to perform the handling operations. As the search for ocean mineral deposits advances into deeper waters and the length of the pipestring increases to reach abyssal depths, it is essential that pipe handling equipment be provided which can safely support the unusually large load of the pipestring and which permits the efficient execution of launching and recovery operations while preserving the structural integrity of the pipestring during the handling operations.

SUMMARY OF THE INVENTION

It is an object of the present invention to provide apparatus for supporting a length of pipe to accommodate pipe stabbing and removal operations during launching or recovery of the length of pipe through an opening in a support platform on a deep ocean mining vessel.

According to one aspect of the invention, the invention may be practiced in combination with a hoist rig of the type having a mast structure secured to a support platform, a traveling block, and power means including a sheave and cable assembly supported by the mast structure which are operatively connected to raise and lower the traveling block. An elevator block is provided for supporting the length of pipe in a make up position at a stabbing station on the support platform. Latching means are carried by the traveling block for releasably coupling the elevator block to the traveling block during pipe running and recovery operations.

In a preferred embodiment, the latching means are mounted for reciprocal and pivotal movement within a latching chamber of the traveling block and extensible linear actuating means interconnect the traveling block and the latching means for effecting movement of the latching means within the latching chamber between an extended position in which coupling occurs and a retracted position in which release occurs. The latching means are guided by the wall of the latching chamber and are radially displaced to permit positive engagement of the latching means with the elevator block in response to axial movement of the latching means from the retracted position to the extended position.

According to the preferred embodiment, the latching means comprise an annular yoke and an array of lifting dogs pivotally mounted on the yoke. Each of the lifting dogs includes a pawl and a seating surface for engaging the elevator block. The extensible linear actuator is a double acting hydraulic actuator having a power cylinder for receiving hydraulic fluid, a two-way hydraulic valve for pressurizing the power cylinder, and having an extendable rod connected to the yoke for extending and retracting the yoke and lifting dogs. In this arrangement, the pawl is operable as a lever arm to cause angular displacement of the lifting dogs into the latching chamber in response to engagement of the pawl with the interior wall of the latching chamber as the yoke is retracted, and the pawl is also operable as a lever arm to cause angular displacement of the lifting dogs out of the latching chamber and into a position permitting positive lifting engagement with a latching hub of the elevator block in response to engagement of the pawl with the latching hub as the elevator block is inserted into the traveling block.

The foregoing and other objects, advantages, and features of the invention will hereinafter appear, and for purposes of illustration, but not of limitation, an exemplary embodiment of the subject invention is shown in the various views of the appended drawing.

DETAILED DESCRIPTION

Figure 1:
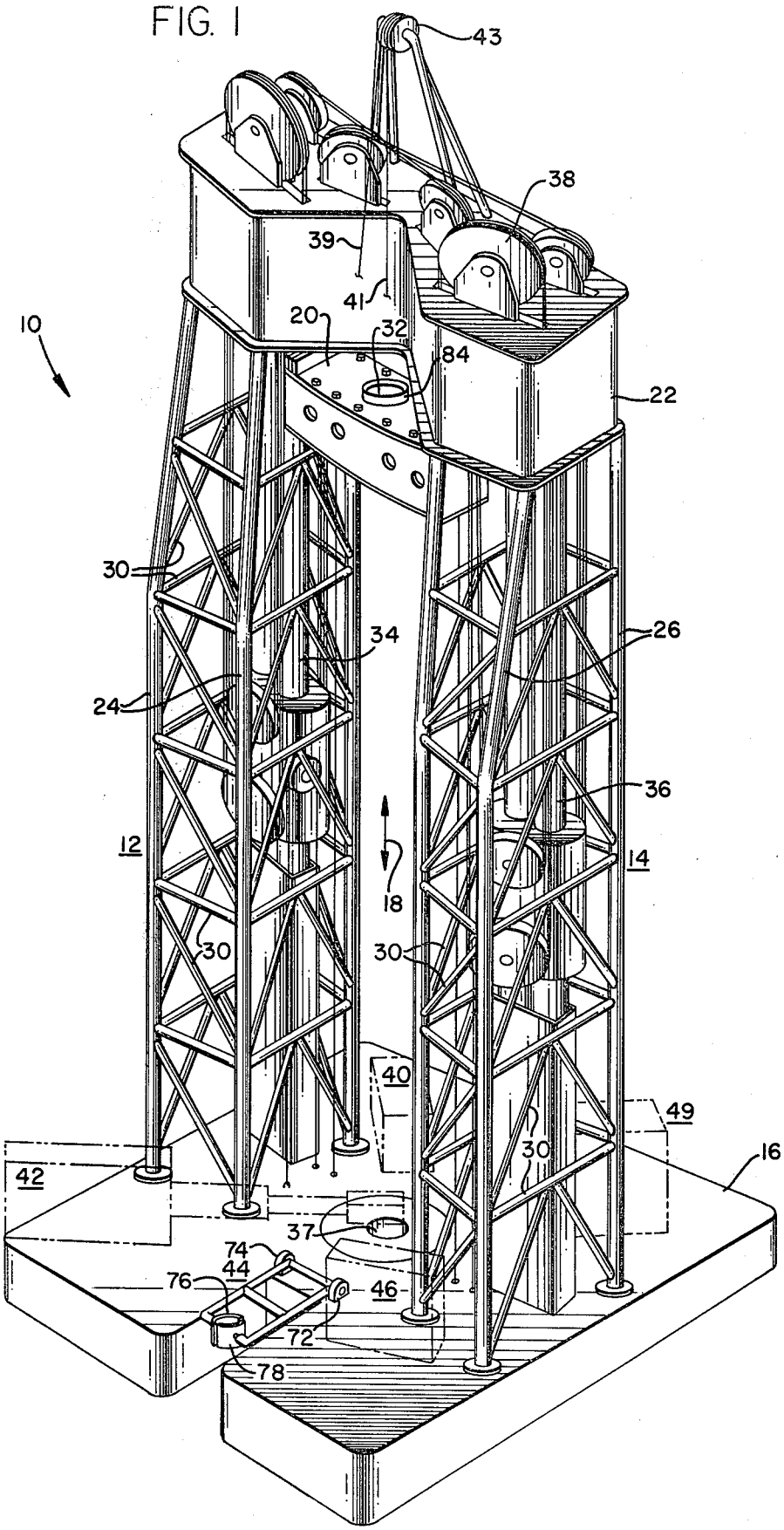
FIG. 1 is an isometric view of a hoist rig having a traveling block and an elevator block constructed according to the teachings of the present invention.

Referring now to the drawing, and more particularly to FIG. 1, a hoist rig constructed according to the teachings of the present invention is designated by the numeral 10 and is shown having a first upstanding mast structure 12 and a second upstanding mast structure 14 laterally spaced from one another on a base platform 16. The base platform 16 may be part of the rig structure for a deep ocean mining vessel, or it may comprise a part of the operating floor of an oil production rig. The hoist rig 10 is specifically constructed for handling unusually heavy loads such as are imposed by vertical pipestrings. Thus the hoist rig of the invention can be used to good advantage in deep ocean mining operations on the high seas, and in oil production operations on the high seas or on land.

The first and second mast structures 12, 14 project perpendicular to the base platform 16 and are laterally spaced apart to define a pipe handling zone 18 through which a traveling block 20 is transported during launching and recovery operations. The upper ends of the first and second mast structures are mechanically interconnected by crown block 22 which improves the mechanical stability of the mast structures.

The first and second mast structures 12, 14 each comprise groups of four tubular upstanding members 24, 26, respectively, which are generally arranged at corners of a square on laterally opposite sides of the base platform 16 and are rigidly secured thereto. Structural cross bracing members 30 are provided to ensure rigidity of each mast structure. For increased structural strength, the tubular members 24, 26 of each mast structure 12, 14 may be pressurized with hydraulic fluid according to the teachings of U.S. Pat. No. 3,960,360 to Thomas L. Elliston, which is hereby incorporated by reference.

The traveling block 20 is vertically guided through the pipe handling zone 18 by cable means 19 according to the teachings of co-pending U.S. application Ser. No. 852,554, entitled "Hoist Apparatus with Dual Mast Structure and Compound Power Transmission System", now U.S. Pat. No. 4,128,229, and assigned to the assignee of the present invention, which is hereby incorporated by reference. The traveling block 20 includes latching means 32 which will be fully described hereinafter. The latching means 32 cooperates with an elevator block 33 to facilitate pipe stabbing and removal during launching and recovery operations. The power to raise and lower the traveling block 20 is provided by first and second extensible linear actuating means 34, 36 which are enclosed by the tubular members 24, 26 of each mast structure, respectively. Each linear actuating means preferably comprises a hydraulic actuator of the type including a mutually extendable piston and housing member. Hydraulic fluid is pumped through passages in the piston rod elements and is discharged inside of the corresponding cylinders. This causes the cylinders to move either up or down, while the pistons remain stationary.

Figure 3:
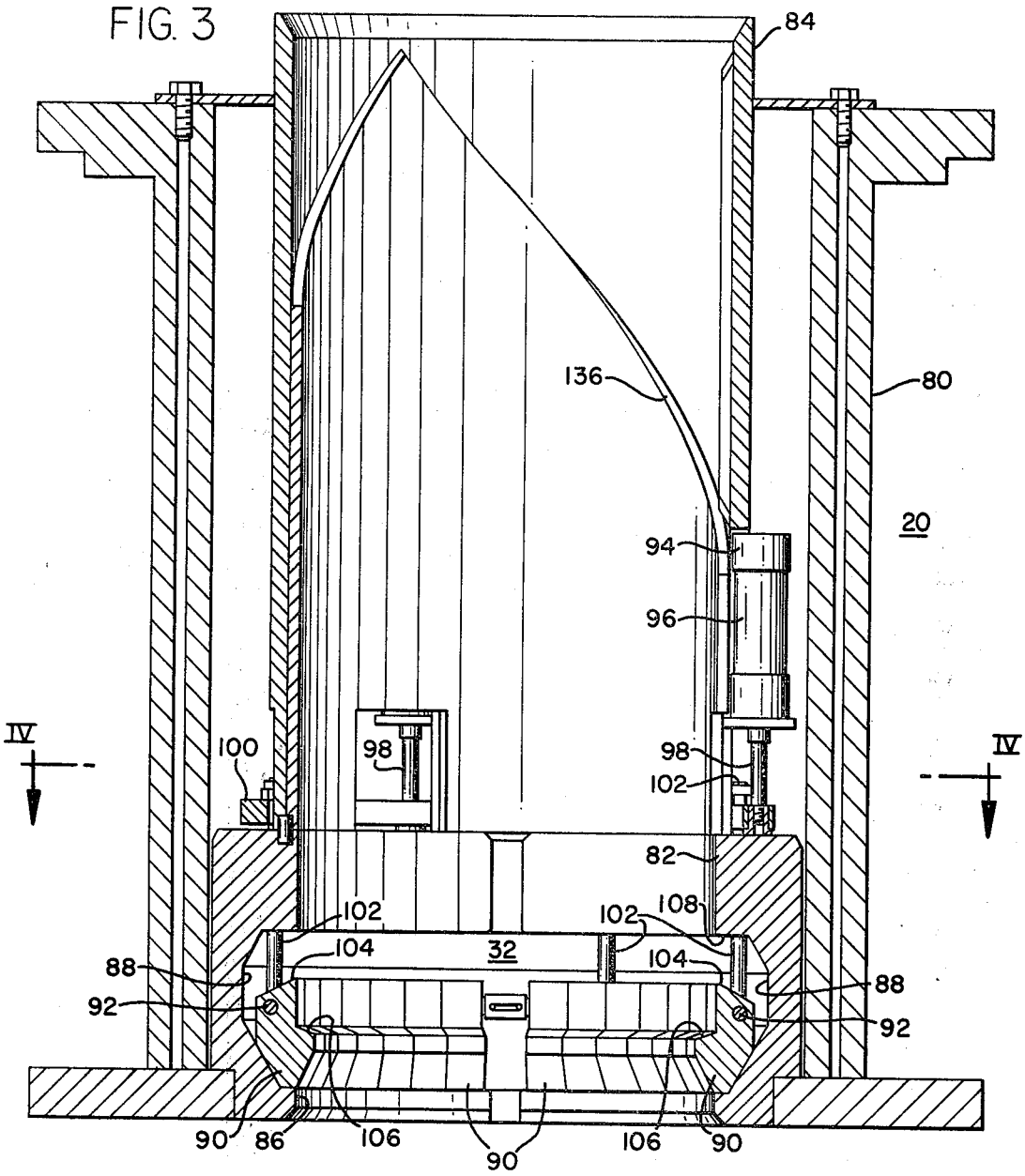
FIG. 3 is an elevation view, in section, which illustrates the construction of the traveling block of the hoist rig shown in FIG. 1 which incorporates latching means constructed according to the teachings of the invention.

The traveling block 20 as shown in FIG. 3 includes the latching means 32 for engaging a section of pipe to be stabbed into a pipestring 150 (FIGS. 10A–10E) during a launching operation, or to be removed from the pipestring during a recovery operation. The lifting force provided by operation of the linear actuators 34, 36 for transporting the traveling block 20 through the pipe handling zone 18 is transmitted to the traveling block 20 by a compound sheave and cable power transmission assembly 38 which may best be understood by reference to the co-pending U.S. application Ser. No. 852,554, as identified above.

Figure 2:
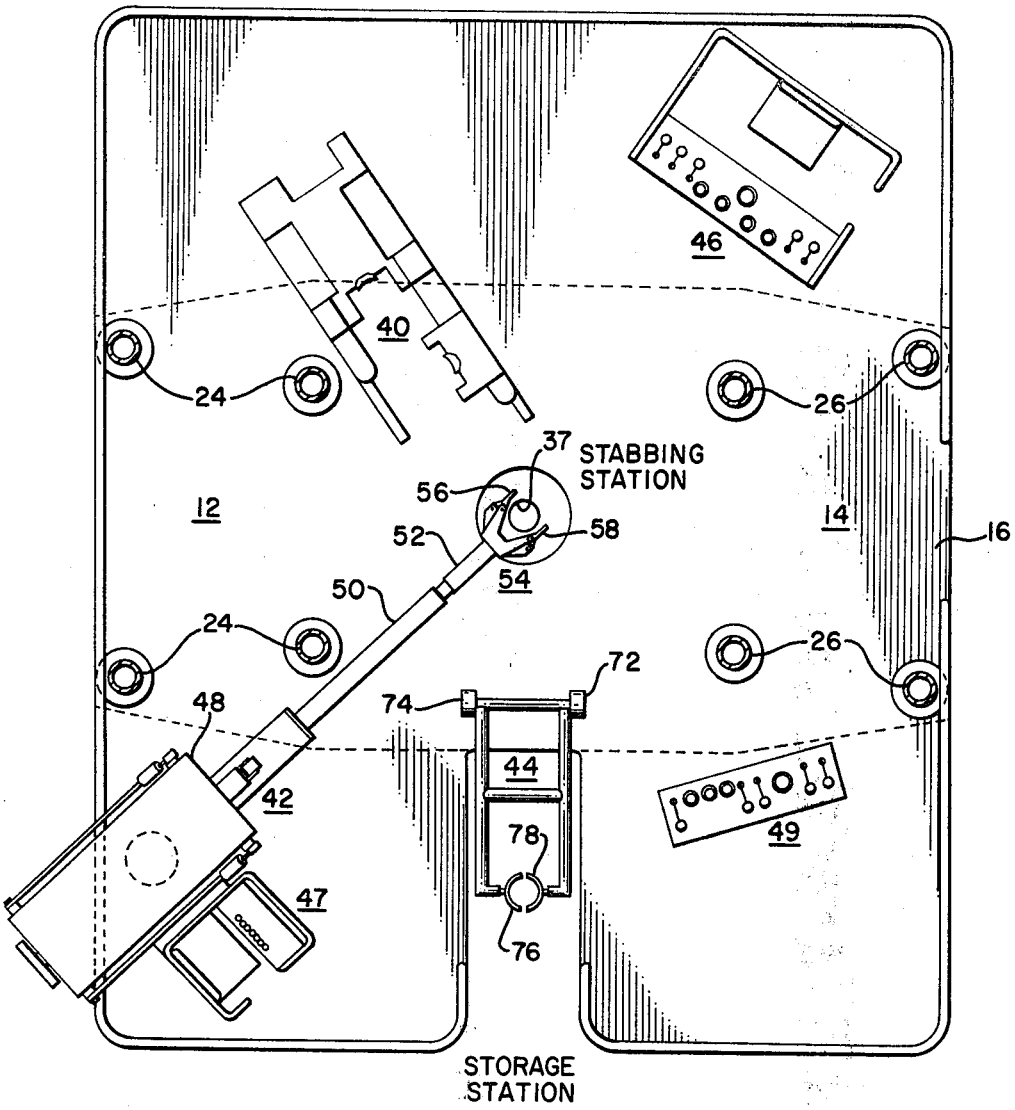
FIG. 2 is a plan view which illustrates the arrangement of automated handling tools on the support platform of the hoist rig shown in FIG. 1.

The traveling block 20 and power transmission assembly 38 of the hoist rig 10 cooperate in a system for launching a pipestring through an opening 37 of the support platform 16 which further includes a spinning head 40, an elevator block transfer apparatus 42, a control arm 44, and a pipe handling console 46, all of which are mounted on the support platform 16 as shown in FIG. 2. The spinning head 40 is remotely operable by the pipe handling console 46 for engaging and rotating a length of pipe as it is stabbed into threaded engagement with a pipestring supported at the stabbing station by the elevator block 33 which will be described in detail hereinafter. An elevator block transfer apparatus 42 is provided for disengaging a first detachable elevator block 33 from the pipestring and transporting it from the stabbing station to the storage station and attaching it to an additional length of pipe which is to be connected to the pipestring. The elevator block transfer apparatus 42 includes a carriage 48 mounted for angular movement through a horizontal plane disposed parallel to the support platform 16 and an extendable arm 50 mounted on the carriage 48 for angular movement relative to the carriage 48 through a vertical plane disposed perpendicular to the support platform 16. The extendable arm 50 includes a wrist assembly 52 mounted on the end of the extendable arm for rotational movement relative to the axis of the arm 50. A bifurcated gripping tool 54 is secured to the wrist assembly 52 which includes first and second fingers 56, 58 which are pivotally mounted on the wrist assembly to permit the fingers 56, 58 to open and close in unison. Further details of the bifurcated gripping tool 54 are illustrated in FIG. 9 of the drawing.

Figure 9:
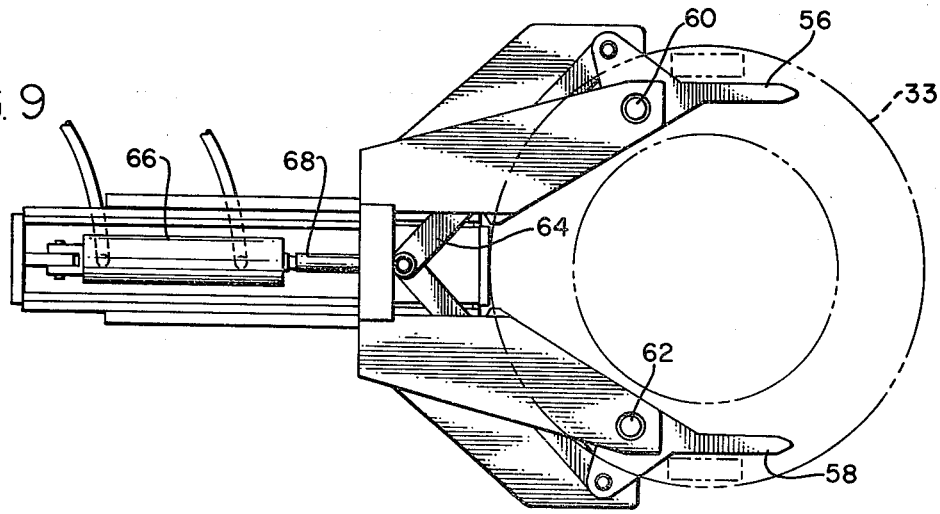
FIG. 9 is a plan view which illustrates construction details of a portion of the elevator block transfer assembly shown in FIG. 2; and, FIGS. 10A–10E are elevational views, partly in section, which illustrate a pipe handling sequence for launching a pipestring by the apparatus of the invention.

As illustrated in FIG. 9, the finger members 56, 58 are pivotally mounted on pins 60, 62 which permits angular displacement of the fingers. Coupling apparatus 64 is provided to link the fingers together for rotational movement in opposite directions to permit the fingers to open and close in unison. An extensible linear actuator 66 which includes an extendable rod portion 68 is secured to the coupling apparatus 64 to cause the fingers to open and close in unison in response to extension and retraction of the coupling apparatus 64 as the rod is extended and retracted. The extensible linear actuator 66 is preferably a hydraulic actuator which includes a two-way hydraulic valve for pressurizing the linear actuator to provide reciprocal movement of the rod 68.

The handling lines 39, 41 which are disposed in reeved engagement with a sheave 43 on the crown block 22 of the mast structure cooperates with the remotely operable control arm 44 to transport a length of pipe from the storage station to the stabbing station and supporting the length of pipe in an elevated make up position in vertical alignment with the axis of the pipestring supported by the detachable elevator block 33 on the support platform 16. As shown in FIGS. 10A–10E, each handling line assembly includes a bail 70, 71 respectively, for engaging the detachable elevator block 33.

The control arm 44 is pivotally mounted on trunnions 72, 74 for movement across the support platform 16 from the storage station to the stabbing station. The control arm 44 includes first and second collar sections 76, 78 for receiving and confining the tubular body portion of a make up section of pipe. The collar portions 76, 78 are mounted for rotation on the control arm 44 to permit angular movement of a make up length of pipe confined by the collar portions relative to the control arm 44 as it moves about its pivot mounting 72, 74. The handling line 39 is terminated by the bail 70 for detachable engagement with the second elevator block 33 so that the make up length of pipe when engaged simultaneously by the second elevator block and control arm 44 with the bail 70 engaging the elevator block may be transported and elevated from the storage station to the stabbing station as the handling line 39 is taken up. The movement of the control arm 44 and take up of the handling line 39 is coordinated by the pipe handling console 49. Likewise, operation of the gripping tool 54 of the elevator block transfer apparatus 42 is coordinated by the gripping tool control console 47. Operation of the hoist rig and traveling block 20 is coordinated by the rig operator console 46.

Generally, at least three men are required to operate the system. One man will operate the rig operator console 46 to control the hoist rig and traveling block 20 and the handling lines 39, 41. A second man will control the spinning head 40 and operation of the gripping tool 54 from the gripping tool control console 47. The third man will operate the pipe handling console 49 which controls the control arm 44 and will manually attach and detach the handling bail 70 to the elevator block 33. Thus it is seen that the traveling block 20, the elevator block transfer apparatus 42, the control arm 44, and the spinning head 40 are all remotely operable and may be selectively operated in cooperation with the elevator blocks 33 and latching means 32 to successively connect lengths of pipe end to end while simultaneously launching the pipestring defined by the connected lengths of pipe. Recovery of the pipestring and removal of sections of pipe from the pipestring can be accomplished by operating the components of the launching system in an essentially reverse order.

Construction of the traveling block 20 and latching means 32 will now be described with reference to FIGS. 3 and 4 of the drawing. The principal components of the traveling block 20 are a carriage assembly 80 for attachment to the hoist cables, a block adapter cradle 82 for enclosing the latching means 32, and a guide cylinder 84 secured to the carriage assembly 80 in axial alignment with the block adapter cradle 82. The block adapter cradle 82 comprises generally an annular block of high strength steel in which a first bore 86 has been machined for receiving the elevator block and having a second bore 88 machined concentric with the first bore for defining a latching chamber for containing the latching means 32.

Figure 4:
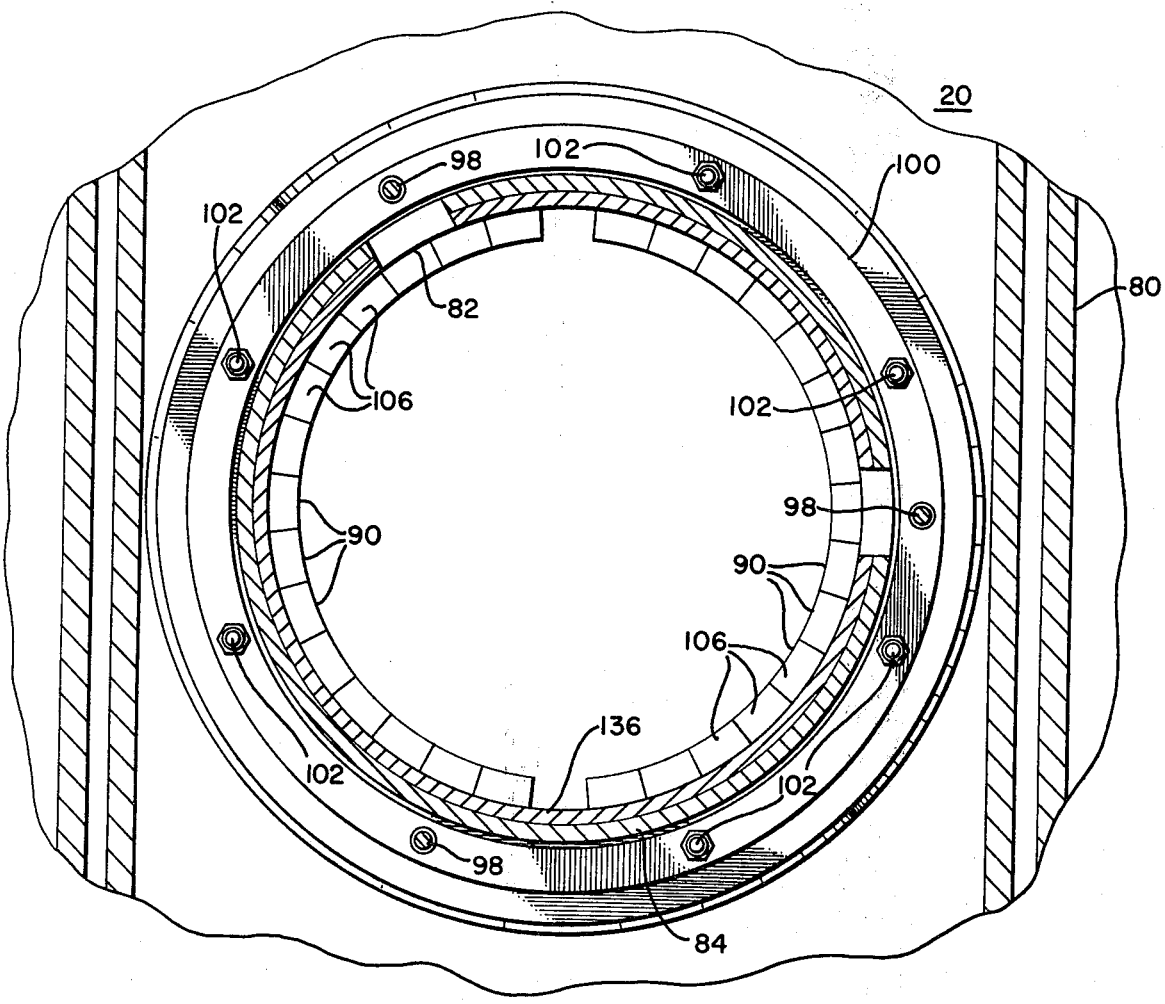
FIG. 4 is a plan view of the latching apparatus shown in FIG. 3 as viewed along the lines IV—IV.

The latching means 32 comprises generally an array of lifting dogs pivotally mounted on an annular yoke 92 in a circular pattern which may best be seen in FIG. 4 of the drawing. The lifting dogs 90 are provided for releasably coupling the elevator block 33 to the block adapter crade 82 in response to vertical movement of the block adapter cradle 82 relative to the elevator block. The latching means 32 including the lifting dogs 90 are mounted for reciprocal and pivotal movement within the latching chamber defined by the second bore 88 between retracted and extended axial positions. Movement of the latching means 32 between the extended position (FIG. 7) and retracted position (FIG. 8) is provided by extensible linear actuating means 94 which interconnect the block adapter cradle and latching means 32. Each linear actuating means 94 is preferably a double acting hydraulic actuator having a power cylinder 96 for receiving hydraulic fluid, a two-way hydraulic valve, and having a rod 98 which is movable in response to changes in the pressure of hydraulic fluid contained in the power cylinder 96.

The retracting force is coupled to the latching means 32 by means of a coupling ring 100 which is secured to the retractable rod 98 and which extends circumferentially around the block adapter cradle 82. Movement of the coupling ring 100 is transmitted to the latching assembly 32 by means of a coupling rod 102 having one end portion connected to the coupling ring 100 projecting through an opening in the block adapter cradle 82 and having its other end portion secured to the yoke 92.

Figure 7:
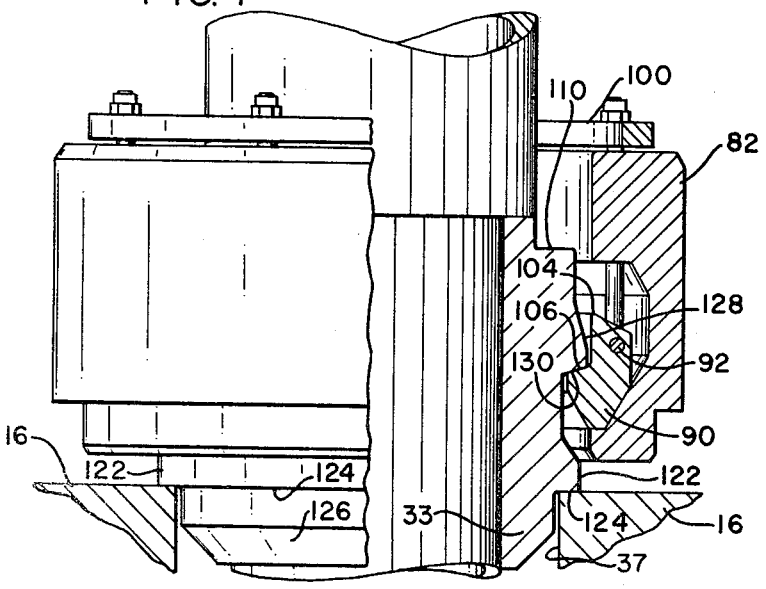
FIG. 7 is an elevation view, partly in section, which illustrates the latched position of the traveling block and elevator block.
Figure 8:
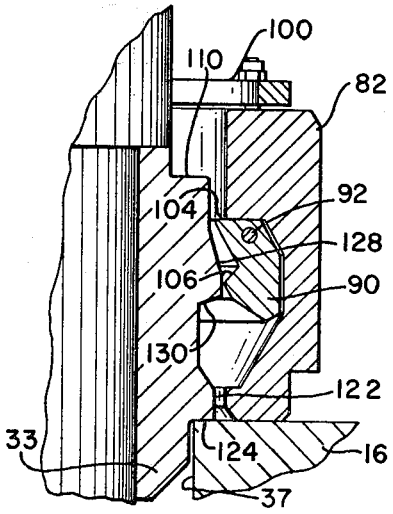
FIG. 8 is an elevation view, partly in section, which illustrates the released position of the traveling block and elevator block.

Referring now to FIGS. 3, 7 and 8, each lifting dog 90 includes a pawl 104 and a seating surface 106 for engaging the elevator block. The pawl 104 is operable as a lever arm to cause angular displacement of the lifting dog 90 into the latching chamber in response to engagement of the pawl with the interior wall of the latching chamber as the yoke 92 is retracted and as the block adapter cradle 82 is displaced axially with respect to the elevator block 33. The force of retraction exerted by the hydraulic actuator 94 causes the yoke 92 and lifting dogs 90 to be displaced axially within the latching chamber 88 as the actuator rod 98 is retracted. Near the end of travel, the pawl 104 engages a wall portion 108 (FIG. 3) of the latching chamber 88 which causes the lifting dog 90 to be displaced angularly in the counterclockwise direction as the travel is completed (FIG. 8). In this position, the latching means 32 is decoupled or disengaged from the elevator block 33 and the traveling block 20 may then be lifted through the pipe handling zone 18 to engage the second elevator block 33 which in combination with the handling line 39 supports a waiting section of pipe for stabbing engagement with the pipestring supported by the first elevator block 33 on the rig floor.

Figures 10A, 10B, 10C, 10D, 10E:
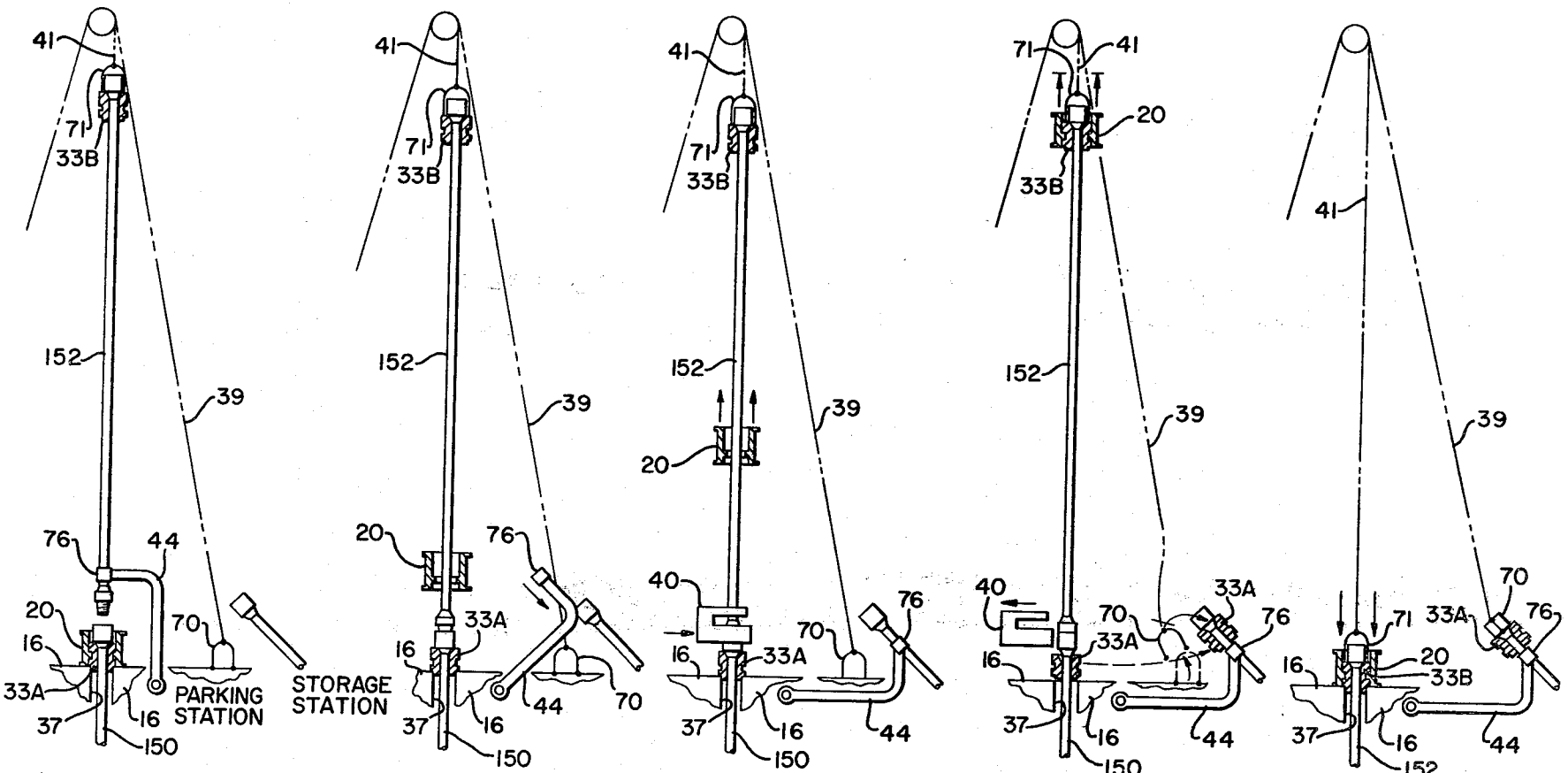

Referring now to FIGS. 7 and 10A, latching engagement of the lifting dogs 90 with the elevator block is initiated by displacing the rod 98 to its extended position thereby placing the pawl 104 of each lifting dog into position for engaging the latching hub 128 of the elevator block 33.

This latching arrangement provides positive coupling of the traveling block 20 to the elevator block 33 and cannot be released until the elevator block has been seated on the rig floor 16. Therefore, inadvertent release and loss of the pipestring cannot occur.

Coupling and release of the traveling block 20 to the elevator block 33 occurs in response to operation of the linear actuator 94 and in response to movement of the traveling block relative to the elevator block which normally occurs during execution of the pipe handling operations. The latching means 32 is operable to mechanically couple the elevator block 33 to the traveling block 20 in response to engagement of the latching means 32 with the elevator block simultaneously with displacement of the traveling block relative to the elevator block through a predetermined vertical distance as the traveling block is raised by the hoist rig. Release of the latching assembly 32 occurs in response to reverse operation of the linear actuator and in response to displacement of the traveling block relative to the elevator block 33 through a predetermined vertical distance as the traveling block and elevator block are lowered onto the support platform 16 by the hoist rig.

Figure 5:
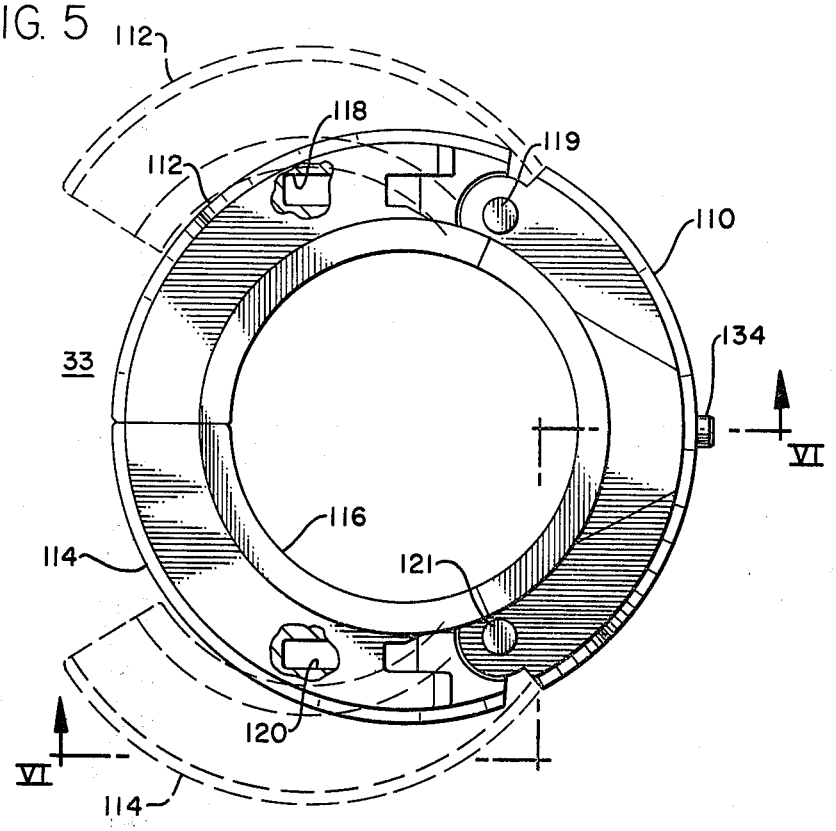
FIG. 5 is a plan view of an elevator block.
Figure 6:
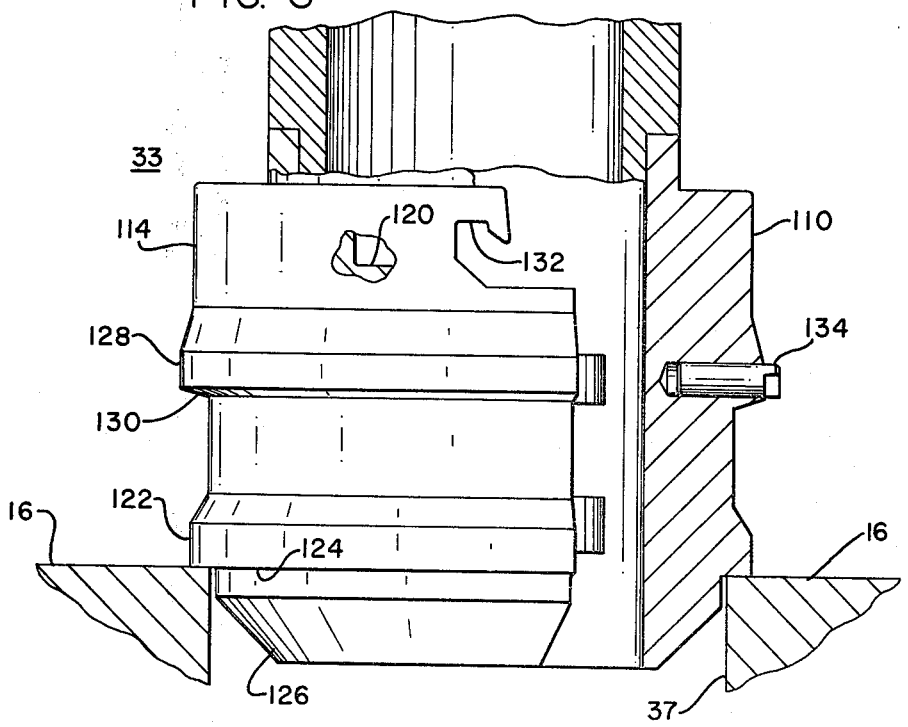
FIG. 6 is an elevation view, partly in section, taken along the line VI—VI of FIG. 5.

Referring now to FIGS. 5 and 6 of the drawing, construction details of the elevator block 33 are illustrated. The elevator block 33 is generally cylindrical and includes cylindrical side portions 110, 112, and 114, which in combination define a bore 116 for enclosing the tubular body portion of a length of pipe. The side portions 112 and 114 are pivotally mounted to the side portion 110 to open and close the bore 116 thereby permitting the elevator block to be placed around or removed from the length of pipe. According to the system described earlier, this is accomplished by means of the gripping tool 54 of the elevator block transfer apparatus 42. Each of the side portions 112, 114 are provided with recesses 118, 120, respectively, for receiving the finger portions 56, 58 of the gripping tool 54. When the coupling apparatus 64 is retracted by the actuator 66, and when the finger portions are disposed in engagement with the openings 118 and 120, the side portions 112 and 114 are opened to expose the bore so that the elevator block 33 can be fitted around the tubular body portion of the length of pipe. The side portions are closed in response to extension of the rod element 68 of the actuator 66 as the finger portions 118 and 120 pivot about the pins 119 and 121.

Referring now to FIG. 6, the elevator block 33 is provided with a first hub 122 having an annular seating surface 124 for engaging the support platform 16. An end portion 126 of the elevator block 33 projects axially into the opening and is disposed in axial registration with the opening 37 in the support platform. The elevator block 33 also includes a second radially projecting hub 128 disposed intermediate the ends of the elevator block having a seating surface 130 for engaging the seating surfaces 106 of the lifting dogs 90 of the latching assembly 32. The elevator block 33 is shown resting on the platform 16 where it supports a length of tubular piping 125 terminated by an internally threaded upset connecting box 127 having an annular lifting shoulder 129. Formed along the upper end of the elevator block 33 is an annular seating surface 131 which is disposed in surface engagement with the annular lifting shoulder 129.

A hook 132 is provided on opposite sides of the elevator block for receiving the bail 70 of the handling line 39. A pin 134 is disposed in the cylindrical side portion 110 for engaging a spiral groove 136 machined into the wall of the guide cylinder 84 in the traveling block 20 as shown in FIG. 3. The purpose of the pin and spiral groove is to automatically position the elevator block 33 in a standard orientation with respect to the gripping tool 54 so that it can readily be engaged by the finger portions 56, 58 to facilitate removal of the elevator block during pipe running operations.

Operation of the pipe handling apparatus of the invention during launching of the pipestring is illustrated in FIGS. 10A–10E of the drawing. In FIG. 10A, a pipestring 150 is shown supported through the opening 37 in the support platform 16 by means of the first elevator block 33A which is engaged by the latching assembly of the traveling block 20. The control arm 44 has been operated to position a make up length of pipe 152 into stabbing make up position in axial alignment with the pipestring and is supported by the second elevator block 33B and a second handling line 41. The bail 70 of the handling line 39 is secured in a parking station as the handling line 41 lowers the length of pipe 152 into stabbing engagement with the pipestring 150 as shown in FIG. 10B. After stabbing engagement occurs, the traveling block 20 is lowered into engagement with the support platform 16 which permits the latching assembly 32 to disengage from the elevator block 33A thereby permitting the traveling block 20 to be lifted from the support floor toward the second elevator block 33B which is supporting the make up length of pipe 152. During this time, the collars 76, 78 of the control arm 44 are disengaged and the control arm is moved away from the stabbing station towards the storage station for engagement with a second make up length of pipe 154. During the transit time of the traveling block 20, the collar assembly 76, 78 of the control arm 44 is assembled around the second make up length of pipe 152 and the spinning head 40 is brought into engagement by operation of the gripping tool control console 47 to apply the proper amount of torque to the threaded tool joint as shown in FIG. 10C. After torquing has occurred, the spinning head 40 is retracted and the traveling block 20 is brought into engagement with the second elevator block 33B whereupon latching occurs as previously discussed. At this time, the load of the pipestring 150 is transferred from the first elevator block to the hoist cable 41 and traveling block, and the pipestring is lifted slightly from the support platform 16 as shown in FIG. 10D to permit the first elevator block 33A to be removed from engagement with the pipestring 150 and transferred to the waiting make up section 152 by the remotely operable elevator block transfer apparatus 42. After the first elevator block 33A has been removed from the pipestring 150, the pipestring including the newly added make up section 152 are lowered by the traveling block 20 and power transmission means 38 until the second elevator block 33B engages the support platform 16 as shown in FIGS. 5 and 10E of the drawing.

During the time that this operation occurs, the operator of the pipe handling console 49 removes the handling line 30 and bail 70 from the parking position and attaches it to the first elevator block 33A which has been secured to the second make up length of pipe 154. The power transmission cables 19 of the hoist rig continue to lower the traveling block 20 until the elevator block 33A is brought into engagement with the support platform 16 as shown in FIG. 10E. Thereafter, the procedure as discussed in connection with FIGS. 10A–10E are repeated for additional make up lengths of pipe until the pipestring 150 has been launched to the proper depth. The recovery of the pipestring is carried out essentially by operating the various components of the launching system in reverse order.

Although the invention as disclosed in the foregoing description of a preferred embodiment has particular utility for launching and recovering a pipestring in the operation of a deep ocean mining vessel, those skilled in the art will appreciate that the apparatus of the invention may be used to good advantage in other fields of application; for example, the apparatus of the invention has utility for lifting and lowering pipe or tubing in the operation of a production oilwell. It should also be understood that various changes, substitutions, and alterations can be made without departing from the spirit and scope of the invention as defined by the appended claims.

What is claimed is:

1. Apparatus for supporting a length of pipe to accommodate pipe stabbing and removal operations during launching or recovery of a length of pipe through an opening in a support platform, the length of pipe being of the type characterized by a tubular body portion terminated by an internally threaded upset connecting box having a shoulder which projects radially with respect to the tubular body portion comprising, in combination:

an elevator block having an axial bore for receiving the tubular body portion and having first and second seating surfaces for engaging the shoulder of the upset connecting box and the surface of the support platform which surrounds the opening, respectively, the first and second seating surfaces being simultaneously engageable by the shoulder of the upset connecting box and support platform, respectively, to permit the length of pipe to be supported in a vertical position with respect to the platform, the elevator block further including a radially projecting latching hub intermediate said first and second seating surfaces for engaging latching means;

a traveling block having a first bore for receiving the elevator block and a second bore of larger diameter concentric with the first bore and having a side wall defining a latching chamber; and, latching means carried by the traveling block including a plurality of lifting dogs disposed in the latching chamber, each lifting dog being moveable between first and second extreme positions, the lifting dogs engaging the side wall of the second bore and projecting radially into the first bore of the traveling block in response to movement of the lifting dogs to the first extreme position to permit latching engagement with the latching hub as the traveling block is lifted, and the lifting dogs being retractable within the latching chamber in response to movement of the lifting dogs to the second extreme position to permit the traveling block and latching means to be displaced axially with respect to the length of pipe without engaging the latching hub.

2. The apparatus as defined in claim 1, the elevator block comprising first and second side portions each being pivotally secured to the elevator block for radial movement about a pivotal axis parallel to the axis of the elevator block, wherein the side portions may be opened and closed to expose the bore thereby permitting the elevator block to be placed around or removed from the tubular body portion of the length of pipe.

3. The apparatus as defined in claim 1 including extensible linear actuating means interconnecting the latching means and the traveling block for effecting movement of the lifting dogs between the first and second extreme positions.

4. The apparatus as defined in claim 3, the traveling block including an annular block adapter cradle in which the first and second bores are formed, the latching means including an annular yoke disposed within the second bore, the lifting dogs being mounted for pivotal movement on the yoke, the extensible linear actuating means being mounted on the block adapter cradle and including an extendable portion mechanically connected to the yoke for moving the yoke and lifting dogs axially between the first and second extreme positions.

5. The apparatus as defined in claim 4, each lifting dog including a pawl and a seating surface for engaging the latching hub, the pawl being operable as a lever arm when engaging the latching hub to cause the locking dogs to pivot about the yoke to place the seating surface into position for positive engagement with the latching hub in response to movement of the lifting dogs from the second extreme position to the first extreme position.

6. Apparatus for supporting a length of pipe to accommodate pipe stabbing and removal operations during launching or recovery of the length of pipe through an opening in a support platform, the length of pipe being of the type having a tubular body portion terminated by an upset connecting box comprising, in combination:

an elevator block having an axially extending bore for receiving the tubular body portion and having first and second radially projecting seating surfaces for engaging the upset connecting box and support platform, respectively, the seating surfaces extending circumferentially around the elevator block and being axially spaced from one another, and a latching hub extending circumferentially around the elevator block and disposed intermediate the first and second seating surfaces;

a traveling block having a base, a crown, a first bore extending axially from the base to the crown for receiving the elevator block, and a second bore concentric with the first bore disposed intermediate the base and crown defining a latching chamber having a diameter greater than the diameter of the first bore;

latching means carried by the traveling block in the latching chamber for engaging or disengaging the latching hub of the elevator block in response to vertical movement of the traveling block relative to the elevator block, the latching means being mounted for reciprocal and pivotal movement within the latching chamber between retracted and extended axial positions, the latching means being guided by the wall of the latching chamber and being radially displaced into the first bore to permit positive engagement of the latching means with the latching hub in response to axial movement of the latching means from the retracted position to the extended position, the latching means being moveable from the first bore into the latching chamber in response to axial movement of the latching means from the extended position to the retracted position; and, extensible linear actuating means interconnecting the latching means and the traveling block for effecting movement of the latching means between the retracted and extended axial positions.

7. In a hoist rig of the type including a mast structure secured to a support platform having a traveling block and power means operatively connected to the traveling block to selectively raise and lower the traveling block, the combination with the traveling block of pipe handling means for releasably engaging a length of pipe to accommodate pipe stabbing operations during launching or recovery of the length of pipe through an opening in the support platform, the pipe handling means comprising:

a detachable elevator block having portions for engaging the length of pipe and support platform for supporting the length of pipe in a vertical resting position through the opening in the support platform during pipe stabbing or removal operations and for supporting the length of pipe in a vertical traveling position as it is displaced through the platform opening during launching and recovery operations; and, latching means carried by the traveling block for releasably coupling the elevator block to the traveling block, the latching means being operable to mechanically couple the elevator block to the traveling block in response to engagement of the latching means with the elevator block simultaneously with displacement of the traveling block relative to the elevator block through a predetermined vertical distance as the traveling block is raised by the power means, and the latching means being operable to mechanically disengage the elevator block and traveling block in response to displacement of the traveling block relative to the elevator block through a predetermined vertical distance as the traveling block and elevator block are lowered onto the platform by the power means.

8. A traveling block for transporting an elevator block in cooperation with power transmission means during launching or recovery of a length of pipe comprising, in combination:

a carriage assembly for attachment to the power transmission means;

an annular block adapter cradle secured to the carriage assembly having a first bore for receiving the elevator block and having a second bore of larger diameter concentric with the first bore defining a latching chamber;

latching means carried by the traveling block for releasably coupling the elevator block to the block adapter cradle in response to vertical movement of the block adapter cradle relative to the elevator block, the latching means being mounted for reciprocal and pivotal movement within the latching chamber between retracted and extended axial positions, the latching means being guided by the wall of the latching chamber and being radially displaced into the first bore to permit positive engagement of the latching means with the elevator block in response to axial movement of the latching means from the retracted position to the extended position, the latching means being withdrawn from the first bore into the latching chamber in response to axial movement of the latching means from the extended position to the retracted position; and, extensible linear actuating means interconnecting the block adapter cradle and latching means for effecting movement of the latching means within the latching chamber between the extended position and the retracted position.

9. A system for launching a pipestring from a support platform comprising, in combination:

a hoist rig having a mast structure secured to the support platform, a traveling block, and power means including a sheave and cable assembly supported by the mast structure operatively connected to raise and lower the traveling block along the mast structure;

first and second detachable elevator blocks for supporting a first length of pipe in a make up position at a stabbing station on the support platform and for supporting a second length of pipe in an elevated make up position relative to the first length of pipe, respectively;

remotely operable means for engaging the second detachable elevator block and transporting it from a storage station to the stabbing station to permit the second length of pipe when engaged by the second detachable elevator block to be transported from the storage station to the stabbing station and supported in the elevated make up position in vertical alignment with the axis of the first length of pipe;

latching means carried by the traveling block for releasably coupling the first and second elevator blocks to the traveling block in succession, respectively, following stabbing and make up of the second length of pipe with the first length of pipe, the latching means being operable to mechanically couple the second elevator block to the traveling block in response to engagement of the latching means with the elevator block simultaneously with displacement of the traveling block relative to the elevator block through a predetermined vertical distance as the traveling block is raised by the power means, and the latching means being operable to mechanically disengage the traveling block from the second elevator block in response to displacement of the traveling block relative to the second elevator block through a predetermined vertical distance as the traveling block and elevator block are lowered onto the platform by the power means;

a remotely operable spinning head mounted on the platform for engaging and rotating the second length of pipe as it is stabbed into threaded engagement with the first length of pipe;

remotely operable elevator block transfer means for disengaging the first detachable elevator block from the first length of pipe, transporting the elevator block from the stabbing station to the storage station, and attaching it to a third length of pipe;

whereby the hoist rig, the remotely operable elevator engaging means, the remotely operable spinning head, and the remotely operable elevator transfer means may be selectively operated in cooperation with the elevator blocks and latching means to successively connect lengths of pipe end-to-end while simultaneously launching the pipestring defined by the connected lengths of pipe.

10. The launching system as defined in claim 9, the remotely operable means for engaging and transporting the second detachable elevator block and second length of pipe from the storage station to the stabbing station comprising:

a remotely operable control arm mounted on the platform for pivotal movement across the platform between the storage station and the stabbing station, the control arm including a collar for receiving and confining the tubular body portion of the second length of pipe, the collar being mounted for rotation on the control arm to permit angular displacement of the second length of pipe confined by the collar relative to the control arm as it moves about its pivot mounting; and, a handling line disposed in reeved engagement with a sheave mounted on the mast structure, the handling line being terminated by a bail for detachable engagement with the second elevator block, whereby the second length of pipe, when engaged simultaneously by the second elevator block and control arm with the bail engaging the elevator block, is transported and elevated from the storage station to the stabbing station as the handling line is taken up.

11. The launching system as defined in claim 9, the remotely operable elevator block transfer means comprising:

a carriage mounted for angular movement through a horizontal plane disposed parallel to the support platform, an extendable arm mounted on the carriage for angular movement relative to the carriage through a vertical plane disposed perpendicular to the horizontal plane, a wrist assembly mounted on the distal end of the extendable arm for rotational movement relative to the axis of the extendable arm; and, a bifurcated gripping tool having first and second fingers pivotally mounted on the wrist assembly, coupling apparatus linking the fingers together for rotational movement in opposite directions to permit the fingers to open and close in unison in response to extension and retraction of the coupling apparatus, and an extensible linear actuator having an extendable portion secured to the coupling apparatus for extending and retracting the coupling apparatus.

12. Apparatus for supporting a length of pipe to accommodate pipe stabbing and removal operations during launching or recovery of a length of pipe through an opening in a support platform, the length of pipe being of the type characterized by a tubular body portion terminated by an internally threaded connecting box having a shoulder which projects radially with respect to the tubular body portion comprising, in combination:

an elevator block having an axial bore for receiving the tubular body portion and having first and second seating surfaces for engaging the shoulder of the connecting box and the surface of the support platform which surrounds the opening, respectively, the first and second seating surfaces being simultaneously engagable by the shoulder of the connecting box and by the support platform, respectively, to permit the length of pipe to be supported in a vertical position with respect to the platform, the elevator block further including a radially projecting latching hub for engaging latching means;

a traveling block having a first bore for receiving the elevator block and a second bore of larger diameter concentric with the first bore and having a side wall defining a latching chamber;

latching means carried by the traveling block including a plurality of lifting dogs disposed in the latching chamber, each lifting dog being movable between first and second extreme positions, the lifting dogs engaging the side wall of the second bore and projecting radially into the first bore of the traveling block in response to movement of the lifting dogs to the first extreme position to permit latching engagement with the latching hub as the traveling block is lifted, and the lifting dogs being retractable within the latching chamber in response to movement of the lifting dogs to the second extreme position to permit the traveling block and latching means to be displaced axially with respect to the length of pipe without engaging the latching hub; and, the traveling block including a guide cylinder secured in axial alignment with the first bore of the traveling block, the guide cylinder having a spiral groove machined along its bore, and the elevator block including a guide pin projecting radially away from the outer periphery of the elevator block for engaging the spiral groove of the guide cylinder as the elevator block is inserted into the guide cylinder.

13. An elevator block for supporting a length of pipe through an opening of a support platform, the length of pipe being characterized by a tubular body portion terminated by a radially upset connecting box, the elevator block comprising first, second, and third side portions which in combination define a cylindrical bore for enclosing the tubular body portion of the length of pipe, the first and second side portions being pivotally mounted on the third side portion to open and close the bore thereby permitting the elevator block to be placed around or removed from the length of pipe, the elevator block further including an annular seating surface formed along one end of the elevator block for engaging the radially upset connecting box of the length of pipe, a first radially projecting hub disposed near the opposite end of the elevator block having a radially projecting seating surface for engaging the support platform surrounding the opening and having an axially projecting end portion for insertion into the opening in axial registration therewith, and a second radially projecting hub disposed intermediate the ends of the elevator block for engaging lifting means, the elevator block including a guide pin disposed in the second radially projecting hub for engaging the lifting means.

14. A traveling block for transporting an elevator block in cooperation with power transmission means during launching or recovery of a length of pipe comprising, in combination:

a carriage assembly for attachment to the power transmission means;

an annular block adapter cradle secured to the carriage assembly having a first bore for receiving the elevator block and having a second bore of larger diameter concentric with the first bore defining a latching chamber;

latching means carried by the traveling block for releasably coupling the elevator block to the block adapter cradle in response to vertical movement of the block adapter cradle relative to the elevator block, the latching means being mounted for reciprocal and pivotal movement within the latching chamber between retracted and extended axial positions, the latching means being guided by the wall of the latching chamber and being radially displaced into the first bore to permit positive engagement of the latching means with the elevator block in response to axial movement of the latching means from the retracted position to the extended position, the latching means being withdrawn from the first bore into the latching chamber in response to axial movement of the latching means from the extended position to the retracted position;

extensible linear actuating means interconnecting the block adapter cradle and latching means for effecting movement of the latching means within the latching chamber between the extended position and the retracted position; and, a guide cylinder secured to the carriage assembly in axial alignment with the first bore of the block adapter cradle, the guide cylinder having a spiral groove machined along its bore.

15. Apparatus for supporting a length of pipe to accommodate pipe stabbing and removal operations during launching or recovery of a length of pipe through an opening in a support platform, the length of pipe being of the type characterized by a tubular body portion terminated by an internally threaded upset connecting box having a shoulder which projects radially with respect to the tubular body portion comprising, in combination:

an elevator block having an axial bore for receiving the tubular body portion and having first and second seating surfaces for engaging the shoulder of the upset connecting box and the surface of the support platform which surrounds the opening, respectively, the first and second seating surfaces being simultaneously engagable by the shoulder of the upset connecting box and support platform respectively, to permit the length of pipe to be supported in a vertical position with respect to the platform, the elevator block further including a radially projecting latching hub for engaging latching means;

a traveling block having a first bore for receiving the elevator block and a second bore of larger diameter concentric with the first bore and having a side wall defining a latching chamber;

latching means carried by the traveling block including a plurality of lifting dogs disposed in the latching chamber, each lifting dog being movable between first and second extreme positions, the lifting dogs engaging the side wall of the second bore and projecting radially into the first bore of the traveling block in response to movement of the lifting dogs to the first extreme position to permit latching engagement with the latching hub as the traveling block is lifted, and the lifting dogs being retractable within the latching chamber in response to movement of the lifting dogs to the second extreme position to permit the traveling block and latching means to be displaced axially with respect to the length of pipe without engaging the latching hub;

extensible linear actuating means interconnecting the latching means and the traveling block for effecting movement of the lifting dogs between the first and second extreme positions;

the traveling block including an annular block adapter cradle in which the first and second bores are formed, the latching means including an annular yoke disposed within the second bore, the lifting dogs being mounted for pivotal movement on the yoke, the extensible linear actuating means being mounted on the block adapter cradle and including an extendable portion mechanically connected to the yoke for moving the yoke and lifting dogs axially between the first and second extreme positions; and, the extensible linear actuating means comprising a hydraulic actuator having a housing portion secured to the traveling block and an extendable rod portion secured to the yoke.

16. Apparatus for supporting a length of pipe to accommodate pipe stabbing and removal operations during launching or recovery of the length of pipe through an opening in a support platform, the length of pipe being of the type having a tubular body portion terminated by an upset connecting box comprising, in combination:

an elevator block having an axially extending bore for receiving the tubular body portion and having first and second radially projecting seating surfaces for engaging the upset connecting box and support platform, respectively, the seating surfaces extending circumferentially around the elevator block and being axially spaced from one another, and having a latching hub extending circumferentially around the elevator block and disposed intermediate the first and second seating surfaces;

a traveling block having a base, a crown, a first bore extending axially from the base to the crown for receiving the elevator block, and a second bore concentric with the first bore disposed intermediate the base and crown defining a latching chamber having a diameter greater than the diameter of the first bore;

latching means carried by the traveling block in the latching chamber for engaging or disengaging the latching hub of the elevator block in response to vertical movement of the traveling block relative to the elevator block, the latching means being mounted for reciprocal and pivotal movement within the latching chamber between retracted and extended axial positions, the latching means being guided by the wall of the latching chamber and being radially displaced into the first bore to permit positive engagement of the latching means from the retracted position to the extended position, the latching means being movable from the first bore into the latching chamber in response to axial movement of the latching means from the extended position to the retracted position;

extensible linear actuating means interconnecting the latching means and the traveling block for effecting movement of the latching means between the retracted and extended axial positions; and, the extensible linear actuating means comprising a double acting hydraulic actuator which is selectively operable, when energized, to continuously exert a retracting force or an extension force on the latching means.

17. The combination as defined in claim 16, the latching means comprising an annular yoke and a plurality of lifting dogs pivotally mounted on the yoke, each lifting dog having a pawl and a seating surface for engaging the latching hub, the hydraulic actuator having a power cylinder for receiving pressurized hydraulic fluid connected to the traveling block and having an extendable rod connected to the yoke, the pawl being operable as a lever arm to cause angular displacement of the lifting dog into the latching chamber in response to engagement of the pawl with the interior wall of the latching chamber as the yoke is retracted, and the pawl being operable as a lever arm to cause angular displacement of the lifting dog out of the latching chamber and into the first bore for positive lifting engagement with the latching hub in response to engagement of the pawl with the latching hub as the elevator block is inserted into the first bore of the traveling block.

18. A traveling block for transporting an elevator block in cooperation with power transmission means during launching or recovery of a length of pipe comprising, in combination:

a carriage assembly for attachment to the power transmission means;

an annular block adapter cradle secured to the carriage assembly having a first bore for receiving the elevator block and having a second bore of larger diameter concentric with the first bore defining a latching chamber;

latching means carried by the traveling block for releasably coupling the elevator block to the block adapter cradle in response to vertical movement of the block adapter cradle relative to the elevator block, the latching means being mounted for reciprocal and pivotal movement within the latching chamber between retracted and extended axial positions, the latching means being guided by the wall of the latching chamber and being radially displaced into the first bore to permit positive engagement of the latching means with the elevator block in response to axial movement of the latching means from the retracted position to the extended position, the latching means being withdrawn from the first bore into the latching chamber in response to axial movement of the latching means from the extended position to the retracted position;

extensible linear actuating means interconnecting the block adapter cradle and latching means for effecting movement of the latching means within the latching chamber between the extended position and the retracted position; and, the extensible linear actuating means comprising a plurality of hydraulic actuators, each actuator being selectively operable, when energized, to continuously exert a retracting force or extension force on the latching means.

19. The traveling block as defined in claim 18, the latching means comprising an annular yoke and an array of lifting dogs mounted on the yoke, each lifting dog having a pawl and a seating surface for engaging the elevator block, the hydraulic actuator having a power cylinder for receiving pressurized hydraulic fluid connected to the block adapter cradle and having a rod which is movable in response to changes in the pressure of hydraulic fluid contained in the power cylinder connected to the yoke, the pawl being operable as a lever arm to cause angular displacement of the lifting dog into the latching chamber in response to engagement of the pawl with the interior wall of the latching chamber as the yoke is retracted, and the pawl being operable as a lever arm to cause angular displacement of the lifting dog out of the latching chamber and into the first bore for positive lifting engagement with the elevator block in response to engagement of the pawl with the elevator block as the elevator block is inserted into the first bore of the block adapter cradle.

* * * * *